US012247336B2

(12) United States Patent
Vernooij

(10) Patent No.: US 12,247,336 B2
(45) Date of Patent: Mar. 11, 2025

(54) APPARATUS FOR MANUFACTURING A PLEATED CURTAIN

(71) Applicant: Eisenkolb Beheer B.V., Eindhoven (NL)

(72) Inventor: Johannes Adrianus Maria Vernooij, Eindhoven (NL)

(73) Assignee: Eisenkolb Beheer B.V., Eindhoven (NL)

( * ) Notice: Subject to any disclaimer, the term of this patent is extended or adjusted under 35 U.S.C. 154(b) by 28 days.

(21) Appl. No.: 18/278,830

(22) PCT Filed: Feb. 22, 2022

(86) PCT No.: PCT/NL2022/050097
§ 371 (c)(1),
(2) Date: Aug. 24, 2023

(87) PCT Pub. No.: WO2022/182231
PCT Pub. Date: Sep. 1, 2022

(65) Prior Publication Data

US 2024/0133094 A1 Apr. 25, 2024
US 2024/0229315 A9 Jul. 11, 2024

(30) Foreign Application Priority Data

Feb. 25, 2021 (NL) ..... 2027651

(51) Int. Cl.
*D05B 35/08* (2006.01)

(52) U.S. Cl.
CPC ..... *D05B 35/08* (2013.01); *D05D 2305/02* (2013.01); *D10B 2503/02* (2013.01)

(58) Field of Classification Search
CPC . D05B 35/08; D05D 2305/02; D10B 2503/02
See application file for complete search history.

(56) References Cited

U.S. PATENT DOCUMENTS 2,669,955 A * 2/1954 Gellman ..... D05B 35/08 223/35
3,576,281 A * 4/1971 Morana ..... A47H 13/14 160/348

(Continued)

FOREIGN PATENT DOCUMENTS

JP S52120053 A 10/1977
JP H0770917 A 3/1995

(Continued)

OTHER PUBLICATIONS

International Preliminary Report on Patentability for International application No. PCT/NL2022/050097, dated Aug. 29, 2023, 8 pages.

(Continued)

*Primary Examiner* — Ismael Izaguirre
(74) *Attorney, Agent, or Firm* — KDW FIRM PLLC

(57) ABSTRACT

A device for manufacturing a pleated curtain includes elongate pleating means for forming a first fold in the curtain by folding the curtain around a long side of the pleating means along a fold line, clamping means for clamping a pleat portion of the curtain on either side of the first fold along a clamping line parallel to the fold line such that the pleat portion forms a loop, and control means for controlling the pleating means and the clamping means. The control means move the pleating means and/or clamping means such that the pleating means are arranged from a position inside the loop to a position adjacent the loop, while the clamping means clamp the pleat portion, such that a remaining portion of the curtain is folded round an outer end of the clamping means and a second fold is formed adjacently of and parallel to the first fold.

17 Claims, 7 Drawing Sheets

(56) References Cited

U.S. PATENT DOCUMENTS

| | | | | | |
|---|---|---|---|---|---|
| 3,661,103 | A | * | 5/1972 | Firestein | D05B 35/08<br>112/134 |
| 3,760,746 | A | * | 9/1973 | Portilla, Jr. | D05B 35/08<br>223/31 |
| 3,822,034 | A | * | 7/1974 | Lawson | A47H 13/14<br>223/28 |
| 3,824,964 | A | * | 7/1974 | Ryan | A47H 13/14<br>112/134 |
| 4,245,576 | A | * | 1/1981 | Crawford | D05B 25/00<br>112/475.08 |
| 4,599,958 | A | * | 7/1986 | Stiers | D05B 35/08<br>112/475.08 |

FOREIGN PATENT DOCUMENTS

| | | |
|---|---|---|
| JP | H7275544 A | 10/1995 |
| NL | 1004021 C2 | 3/1998 |

OTHER PUBLICATIONS

International Search Report and Written Opinion for the International Application No. PCT/NL2022/050097, mailed Jun. 13, 2022, 13 pages.

* cited by examiner

APPARATUS FOR MANUFACTURING A PLEATED CURTAIN

This application is a national stage filing under 35 U.S.C. 371 of pending International Application No. PCT/NL2022/0050097, filed Feb. 22, 2022, which claims priority to Netherlands patent application 2027651, filed Feb. 25, 2021, the entirety of which applications are incorporated by reference herein.

The present invention relates to a device for manufacturing a pleated curtain.

A known device for manufacturing curtains with multiple pleats typically comprises an automated folding station for arranging multiple pleats which co-acts with a sewing station which is provided with a sewing machine for stitching the multiple pleats. The folding station is disposed separately of the sewing station and typically has two sets of mutually adjacently arranged, vertically oriented plate-like elements, wherein the elements of the one set are disposed offset opposite those of the other set. The sets form in cross-sectional view as it were two combs, the teeth of which are arranged with their outer ends offset opposite each other such that the teeth of the one comb can be arranged between the teeth of the other comb by vertical movement. By arranging curtain fabric between the sets and sliding the pleating blades of the two sets vertically into each other folds/pleats are arranged in the curtain fabric. A multiple pleat is then obtained by (i) moving the blades in each set toward each other so that a compact package of pleats and pleating blades is obtained and the folds in this package are held together, (ii) then transporting the package of folds and pleating blades to the sewing machine, wherein the package must be rotated through 90 degrees in order to be arranged horizontally on the table of the sewing machine, (iii) removing the pleating blades from the package and (iv) stitching the folds/pleats with the sewing machine.

In order to arrange a triple pleat in the curtain fabric seven pleating blades are needed, which are slid into each other. This causes the folding station to comprise many moving parts.

Subsequently transporting the triple pleat to the sewing station means that the package of all seven blades with the curtain fabric therebetween must be displaced to the sewing machine and rotated in order to arrange the package on the table of the sewing machine. This requires a relatively complex mechanism.

The complex mechanism consisting of a relatively large amount of components is moreover expensive to manufacture and maintain.

Such a device further has a relatively large size due to the presence of two stations.

Finally, it is important when forming the folds/pleats in the curtain fabric with the pleating blades of the known device that the fabric co-displaces with the pleating blades but at the same time also lies tightly therearound. This requires a great deal of experience and skill on the part of the person operating the device.

All aspects stated above form drawbacks of the known device.

It is therefore an object of the present invention to provide a device for arranging multiple pleats in a curtain which is easier to operate, more compact and cheaper.

The present invention provides for this purpose a device for manufacturing a pleated curtain, comprising elongate pleating means configured to form a first fold with a predetermined pleat height in the curtain by folding the curtain round a long side of the pleating means along a fold line, clamping means configured to clamp a pleat portion of the curtain on either side of the first fold over the predetermined pleat height at least along a clamping line parallel to the fold line and at a predetermined pleat depth distance from the fold line, such that the pleat portion, as seen in a cross-sectional plane perpendicular to the fold line, forms a U-shaped loop, and control means for controlling the pleating means and the clamping means, wherein the control means are configured to move the pleating means and/or the clamping means relative to each other such that, as seen in said cross-sectional plane, the pleating means are arranged from a position inside the loop to a position adjacently of the loop, while the clamping means clamp the pleat portion, such that a remaining portion of the curtain differing from the pleat portion is folded round an outer end of the clamping means and at least a second fold round the pleating means arranged adjacently of the loop is formed adjacently of and parallel to the first fold. The second fold here forms a second pleat portion, i.e. a second loop in the curtain adjacently of the loop clamped by the clamping means.

Since the device is configured to move the pleating means out of the loop and arrange them adjacently of the pleat portion, i.e. the first pleat, while the clamping means hold the pleat portion, both the first fold and the second fold can be formed using the same pleating means. The device according to the present invention can thereby form pleats with fewer components than known devices for arranging a multiple pleat in a curtain. This makes the device according to the present invention more compact and cheaper than said known devices. Because the control means are configured to move the pleating means and/or the clamping means relative to each other such that pleated portions can thereby be arranged adjacently of each other, the device enables both single and double, triple or multiple pleats to be arranged in a curtain using the same pleating means.

The pleating means and the clamping means are preferably configured to arrange the first and the second fold and the pleat portions corresponding therewith in the curtain by means of substantially horizontal relative movement of the pleating means and the clamping means, such that the pleat depth dimension extends substantially in horizontal direction. The pleats are hereby already horizontally oriented and no mechanism is needed to rotate the pleats in order to arrange them on the table of the sewing machine. This makes the device mechanically simpler, more compact and cheaper than known devices for arranging a multiple pleat in a curtain. It is noted in this respect that the pleat depth is the dimension of the pleat as it protrudes forward relative to the adjacent curtain material. The pleat height is the height dimension of the pleat when the curtain is hung.

The pleating means and the clamping means are preferably arranged in the vicinity of a table of a sewing machine. The sewing machine is more preferably integrated with the device. The pleating means and the clamping means are most preferably arranged behind a stitching needle of the sewing machine.

It is further noted that the terms 'fold' and 'pleat' have the same meaning as each other, i.e. the line along which the curtain/the curtain fabric is folded over. In the present application the term pleat is however also used to indicate the portion of the curtain fabric which has been folded over once or multiple times for the purpose of forming respectively a single or multiple pleat in the curtain, and which extends.

In a preferred embodiment the control means are further configured to successively (i) arrange the clamping means round the pleat portion such that the clamping means at least make contact with the pleat portion, wherein the pleating means are arranged in the loop, (ii) move the pleating means away from the fold line in a pleat depth direction perpendicularly of the fold line over a distance greater than the predetermined pleat depth distance, such that the pleating means move out of the loop, (iii) clamp the loop at the predetermined pleat depth distance with the clamping means, and (iv) move the pleating means along an outer side of the clamping means and arrange them adjacently of the loop.

In a preferred embodiment the pleating means comprise two elongate pleating fingers which extend parallel to each other in their longitudinal direction and are movable between a closed state, in which the pleating fingers lie against each other along their length, and an open state in which the pleating fingers are removed a distance from each other such that they can each be arranged on one of either side of the loop by the movement of the pleating means and/or the clamping means perpendicularly of the extending direction of the fold line, while the clamping means clamp the loop.

Both the first fold/pleat and a second and a third fold/pleat can thus be formed using the two elongate pleating fingers, wherein the clamping means clamp the first pleat portion while the second and the third fold/pleat are formed. A triple pleat can be arranged in the curtain using the same pleating means by relative movement thereof relative to the clamping means. The device according to the present invention can thereby form a triple pleat with far fewer components than the known device for arranging a triple pleat, wherein use is made of seven pleating blades. The device according to the present invention is thereby more compact and cheaper than said known devices.

The pleating fingers and the clamping means are preferably configured to arrange the pleating fingers on either side of the loop while the clamping means clamp the loop, i.e. to form the first, the second and the third fold and the pleat portions corresponding therewith, by means of substantially horizontal relative movement of the pleating fingers and the clamping means, such that the pleat depth dimension extends substantially horizontally. The pleats are hereby already horizontally oriented and no mechanism is needed to rotate the pleats in order to arrange them on the table of the sewing machine. This makes the device mechanically simpler, more compact and cheaper than known devices for arranging a triple pleat in a curtain.

In a preferred embodiment the control means are configured to hold the pleating fingers in the closed state until the pleating fingers are situated outside the loop and to bring them into the open state before the pleating fingers are arranged adjacently of the loop along the outer side of the clamping means. In this way the pleating fingers "pull" on the curtain fabric as little as possible when the pleating fingers are moved out of the loop. The outer surface of the pleating fingers directed toward the fabric is preferably convex and/or smooth, so that the friction force between the pleating fingers and the curtain fabric when the surface of the pleating fingers and the surface of the curtain fabric slide along each other—both when moving the pleating fingers out of the loop and when arranging them adjacently of the clamping means—is reduced.

In a preferred embodiment an intermediate space is formed between the pleating fingers in the open state, this having a height such that the clamping means with the loop therebetween can be arranged in the intermediate space and wherein the control means are further configured to enable the pleating fingers to be arranged on either side of the loop by moving the clamping means with the loop therebetween into the intermediate space. The intermediate space between the pleating fingers is preferably at least twice as large as the greatest distance between the two outer surfaces of the clamping means at the position of the portion situated between the pleating fingers, wherein each of the two outer surfaces is directed toward one of the pleating fingers when the clamping means are situated between the pleating fingers.

In a preferred embodiment the control means are configured to arrange the pleating means at the position of the fold line of the first fold on the outer side of the loop. In this way a triple pleat is obtained with three pleated portions, each having the same pleat depth.

In a preferred embodiment the device further comprises a table for arranging thereon the curtain pleated round the pleating means and a presser foot arranged opposite the table and configured to press the pleated curtain against the table on a side of the clamping line remote from the fold line. The presser foot ensures that the curtain fabric arranged round the pleating means remains in place when the pleating means and/or the clamping means are moved, so that the position of the fold(s) does not change when the pleating means and/or the clamping means move. This ensures that an optionally multiple pleat yet to be arranged is arranged at the correct distance from a directly adjacent, optionally multiple pleat already arranged previously.

In a preferred embodiment the control means are configured to move the presser foot toward the table in order to press the curtain against the table with the presser foot until the pleating means are outside the loop and the clamping means clamp the loop.

In a preferred embodiment the control means are configured to move the presser foot away from the table after the pleating means have been arranged outside the loop and the clamping means clamp the loop, and before the pleating means are arranged adjacently of the loop. Because the presser foot is moved away from the table at this moment, the fabric is given space so that the pleating means, preferably the two elongate pleating fingers, can spread the fabric and can fold it round the clamping means.

In a preferred embodiment the device further comprises a presser plate configured to press the loop and pleated portions of the curtain lying adjacently of the loop against the table, wherein the control means are configured to move the presser plate toward the table in order to press the curtain against the table with the presser plate after the pleating means have been arranged adjacently of the loop. The presser plate ensures that the package of a plurality of pleated portions stays together such that the folds of the pleated portions are each held at their desired position, i.e. along the desired fold line.

In a preferred embodiment the presser plate is provided on the presser foot, such that a movement of the presser foot from and to the table results in a movement of the presser plate respectively from and to the table.

In a preferred embodiment the device further comprises fixing needles configured to fix the loop and the pleated portions of the curtain lying adjacently of the loop relative to each other by arranging the fixing needles through the loop and the pleated portions of the curtain lying adjacently of the loop. The fixing needles enable the pleating means, clamping means and the presser plate to be moved away from the package of a plurality of pleated portions, while the pleats remain in place. Removing the pleating means, clamping means and the presser plate is necessary in order to then be able to stitch the optionally multiple pleat using a sewing device.

In a preferred embodiment the clamping means comprise recesses for arranging the fixing needles therethrough. This enables the fixing needles to be arranged through the loop and the pleated portions of the curtain lying adjacently of the loop, while the loop and the pleated portions of the curtain lying adjacently of the loop are held in their desired place by the clamping means.

In a preferred embodiment the control means are further configured to arrange the fixing needles through the loop and the pleated portions of the curtain lying adjacently of the loop after the presser plate presses the curtain against the table after the pleating means have been arranged adjacently of the loop. In this way the presser plate ensures that the pleated portions do not shift relative to each other due to movement of the fixing needles through the pleated portions.

In a preferred embodiment the control means are further configured to move the clamping means and the pleating means away from the loop and the pleated portions of the curtain lying adjacently of the loop after the fixing needles have been arranged through the loop and the pleated portions of the curtain lying adjacently of the loop, such that the loop and the pleated portions lying adjacently of the loop lie clear of the clamping means and the pleating means.

In a preferred embodiment the control means are further configured to move the presser plate away from the table before the clamping means and the pleating means are moved away from the loop and the pleated portions of the curtain lying adjacently of the loop, and to move the presser plate toward the table after the loop and the pleated portions lying adjacently of the loop have come to lie clear of the clamping means and the pleating means. Moving the presser plate away from the table before the clamping means and the pleating means are moved away from the loop and the pleated portions of the curtain lying adjacently of the loop prevents excessive friction forces between the clamping means and the pleating means on one side and the curtain fabric on the other, which cause the pleated portions to shift relative to each other when the clamping means and the pleating means are removed.

In a preferred embodiment the device further comprises a sewing device for fixing the loop and portions of the curtain pleated adjacently of the loop by means of stitching, such that the portions pleated adjacently of the loop form loops adjacently of the loop.

The present invention will be further elucidated with reference to the following figures, which show preferred embodiments of the device for manufacturing a pleated curtain according to the invention and are not intended to limit the scope of protection of the invention in any way, wherein.

Figure 1:
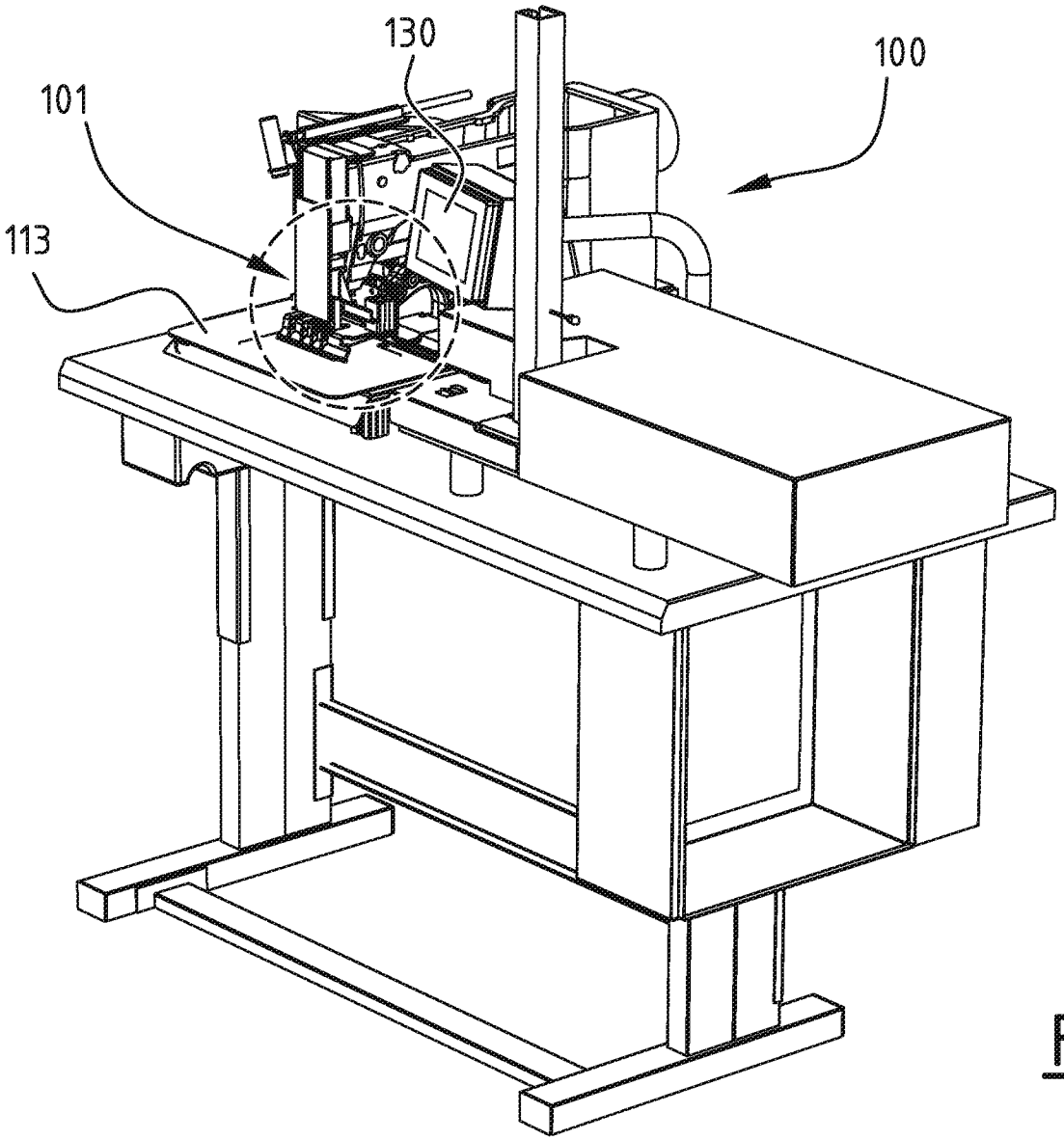
FIG. 1 is a perspective view of an embodiment of the device according to the present invention.

FIG. 1 shows a machine 100 for manufacturing a pleated curtain 200. Machine 100 is particularly suitable for arranging a triple pleat 250 in a curtain. Whereas in known devices such a triple pleat is arranged using a folding station disposed separately of the sewing machine and having seven mutually engaging pleating blades, the functionality of both the folding and the sewing is integrated compactly in the machine 100 of FIG. 1.

For this purpose the machine 100 specifically has a device 101 for arranging a triple pleat 250 in the vicinity of means for fixedly stitching the pleat in the curtain. This makes the machine 100 very compact.

Figure 2:
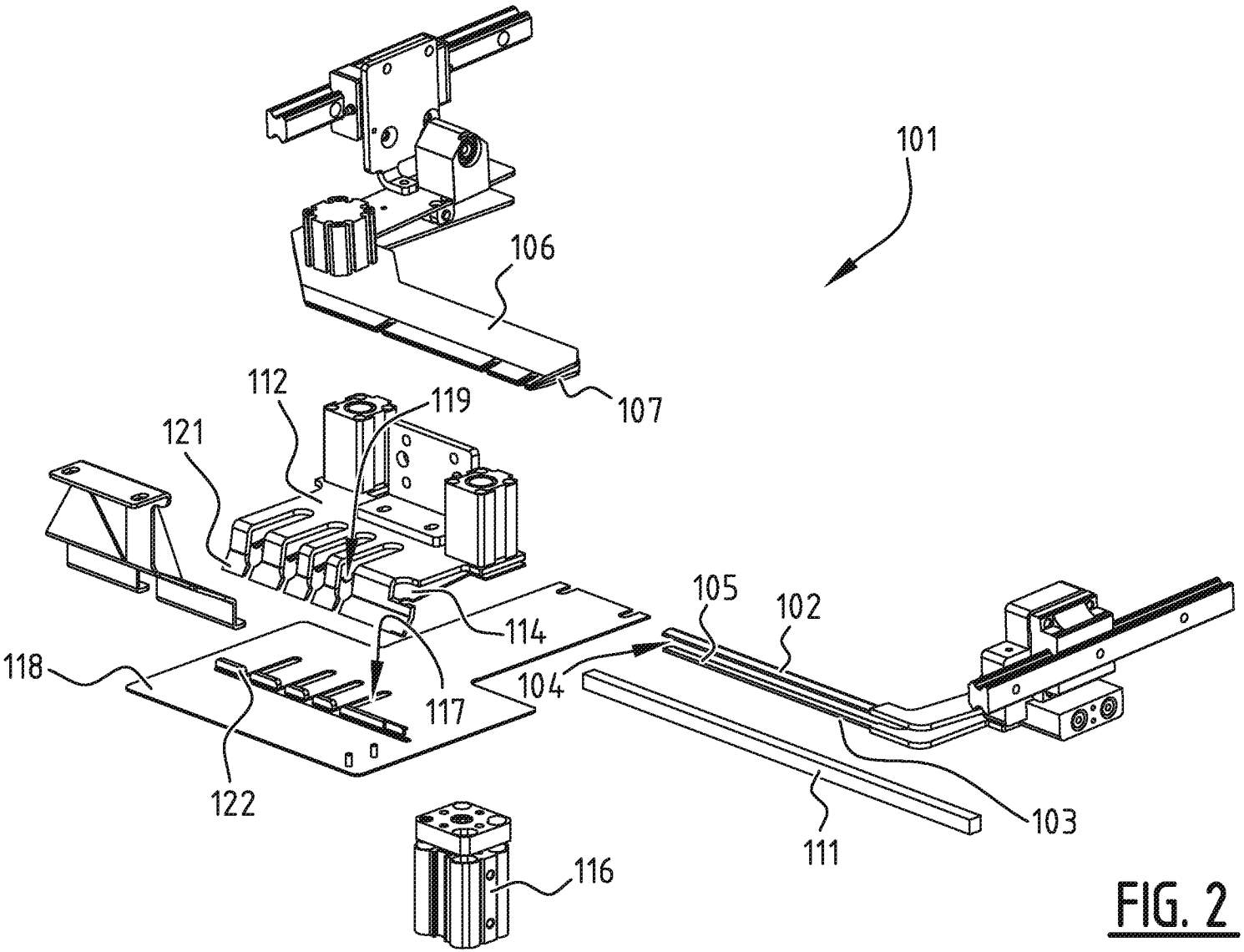
FIG. 2 is an exploded view of various components of the device of FIG. 1.
Figure 3:
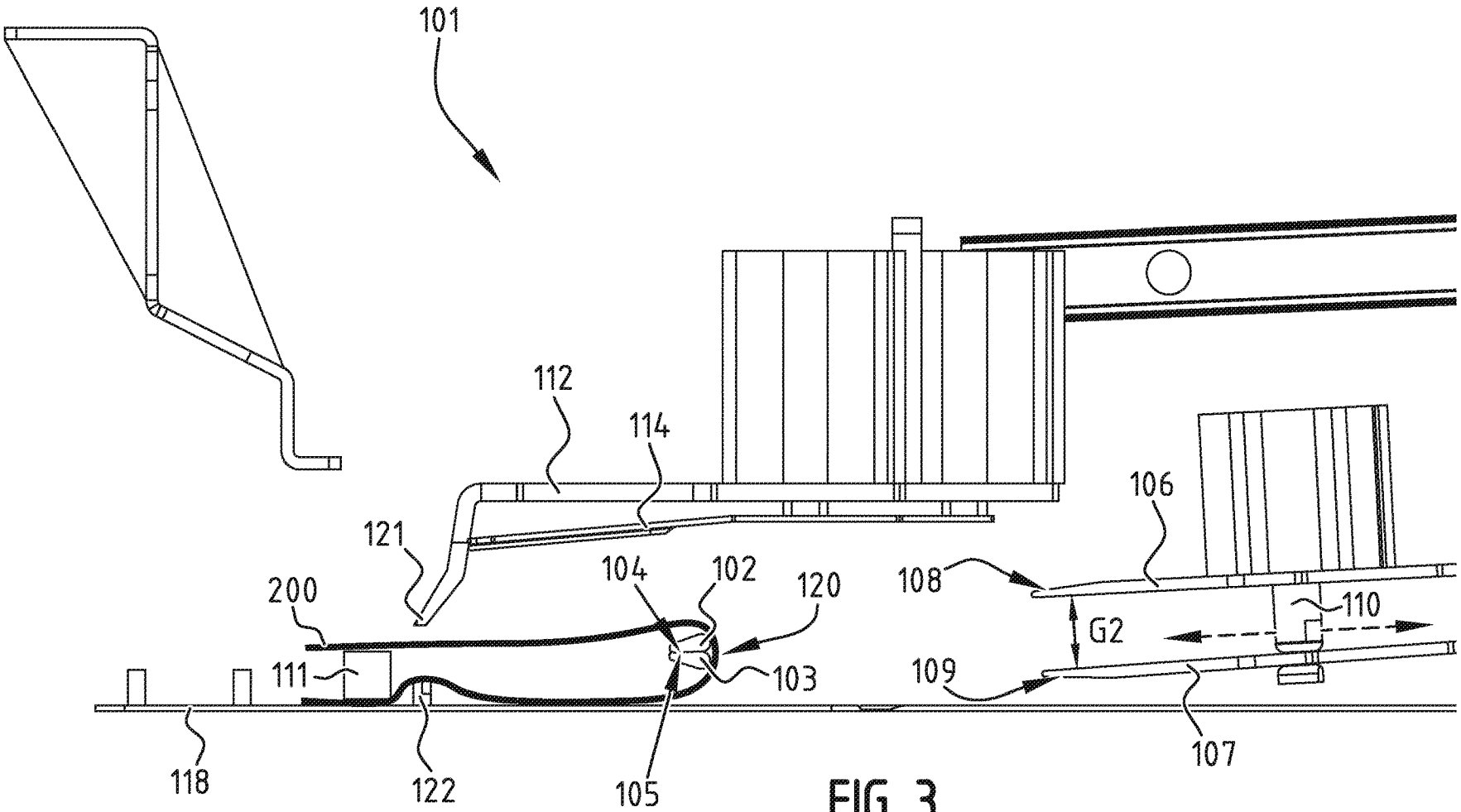
FIGS. 3-7 are cross-sectional side views of the various components of FIG. 2 as combined in the device of FIG. 1, wherein each of the figures shows a random view during the manufacture of a triple pleat in a curtain.

Forming the triple pleat 250 is done with the device 101 as circled in FIG. 1. An exploded view of components of this device 101 is shown in FIG. 2.

The components comprise among other things a set of two pleating fingers 102, 103 extending parallel to each other. The pleating fingers 102, 103 are movable between a closed state, in which mutually facing, longitudinally extending surfaces 104, 105 of pleating fingers 102, 103 lie one on the other, and an open state in which pleating fingers 102, 103 lie at a mutual distance with an intermediate space G1 between said surfaces 104, 105.

The device further has a set of two pleating blades 106, 107 which are movable for pivoting round pivot shaft 108 between an open state, in which outer ends 108, 109 of pleating blades 106, 107 which are directed toward a curtain 200 arranged in machine 100 lie at a mutual distance with an intermediate space G2 therebetween, and a closed state in which the outer ends 108, 109 are arranged one on the other. Moving the pleating blades 106, 107 away from and toward each other is done by means of moving a spacer 110 arranged between pleating blades 106, 107 respectively away from said outer ends 108, 109 and toward said outer ends 108, 109.

Device 101 additionally has a lance or knock-out pin 111 for arranging a hook also to be stitched into pleat 250 for the purpose of attaching the curtain 200 to a curtain rail at the position of the pleat.

Device 101 further has a presser foot 112 for keeping curtain 200 in place on a table 113 of machine 100 while the triple pleat 250 is being formed in curtain 200. Arranged on a side of presser foot 112 facing toward the curtain 200 is a biased presser plate 114 for keeping the pleats of the triple pleat 250 together before they are fixed relative to each other using fixing needles 115.

The fixing needles 115 are situated under the table 113 and are movable between a position in which the outer ends of needles 115 are situated under table 113 and a position in which the outer ends of needles 115 extend to a position above the upper pleat of the triple pleat 250. For this purpose fixing needles 115 are arranged in a special moving unit 116 to enable fixing needles 115 to be moved upward and downward.

At the position where the pleat is stitched the table 113 has an opening which is covered with a table plate 118 provided with recesses 117. The recesses 117 have a position, shape and size such that they ensure that a stitching needle of the sewing machine is able to secure the triple pleat 250 by means of stitching through pleat 250 and table 113. The presser foot 112 and the presser plate 114 also have recesses 119, corresponding with the table plate recesses 117, for moving the stitching needle therethrough.

In order to be able to arrange the fixing needles 115 through the triple pleat 250 held together by the pleating blades 106, 107, presser foot 112, presser plate 114 and table plate 118 the pleating blades 106, 107 and the table plate 118 are each provided with recesses for moving the fixing needles 115 therethrough.

Forming a triple pleat 250 with the shown device 101 is done as follows, wherein reference is made to FIGS. 3-7, each showing a random view during the process of manufacturing the triple pleat 250 in curtain 200.

A portion of the fabric of curtain 200 to be pleated is firstly arranged round the pleating fingers 102, 103, wherein pleating fingers 102, 103 are in the closed state. This creates a fold 120 in curtain 200 at the position of pleating fingers 102, 103. At the same time as the fabric being arranged round pleating fingers 102, 103, the fabric is arranged around the knock-out pin 111, on which is arranged a hook to be stitched into the pleat. The knock-out pin 111 is here situated on a side of presser foot 112 remote from fold 120.

Figure 4:
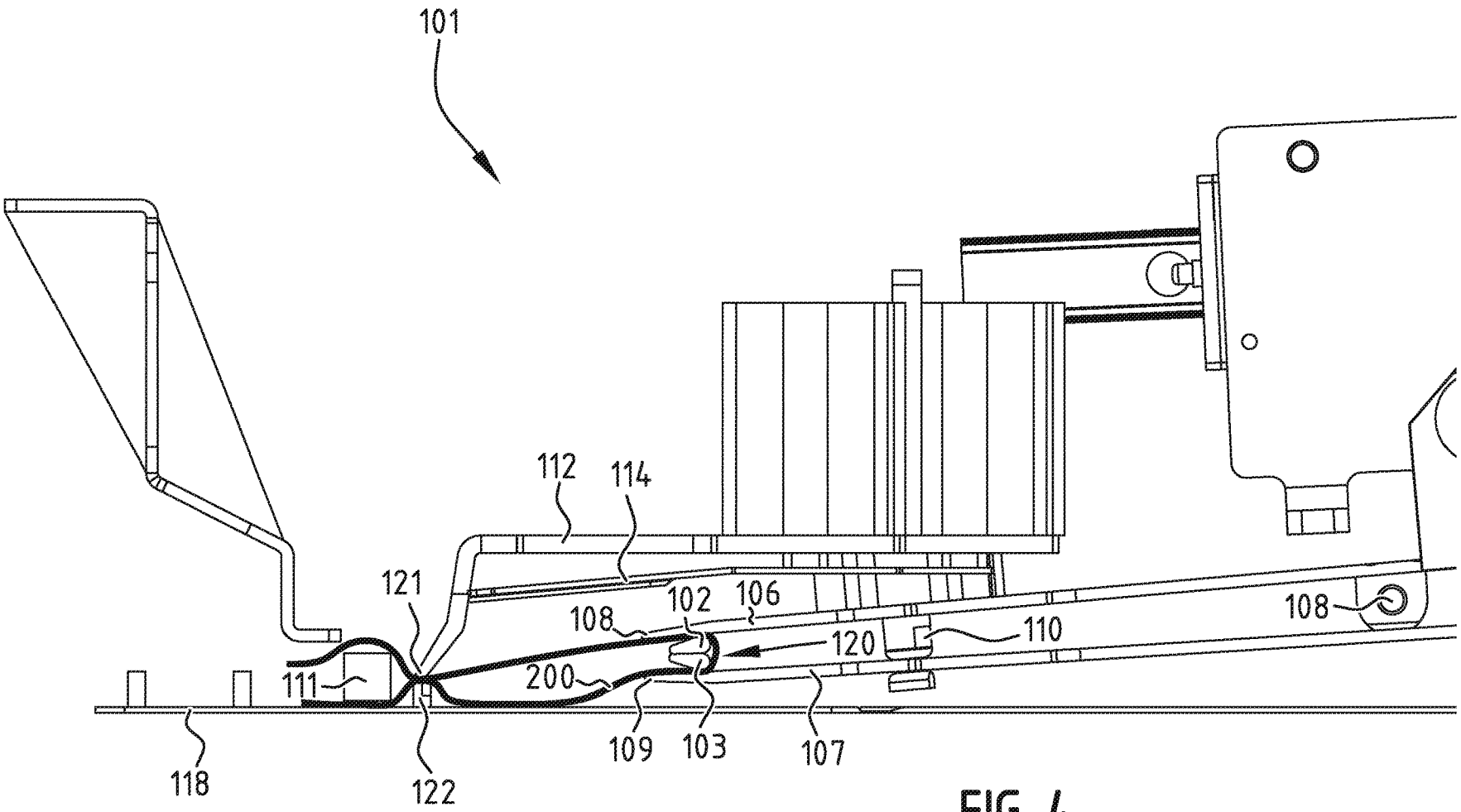

Presser foot 112 is then moved toward table plate 118 such that the curtain fabric 200 is clamped between outer ends 121 of presser foot 112 and upright edges 122 of table plate 118 placed opposite the outer ends 121 of presser foot 112. After this, the pleating blades 106, 107 are arranged round the curtain fabric 200 arranged round pleating fingers 102, 103 and moved to the closed state in order to engage curtain fabric 200 on either side of the fold 120 with pleating fingers 102, 103 therein with such force that the position of the fold 120 is preserved when pleating fingers 102, 103 move away from fold 120. This is shown in FIG. 4.

Figure 5:
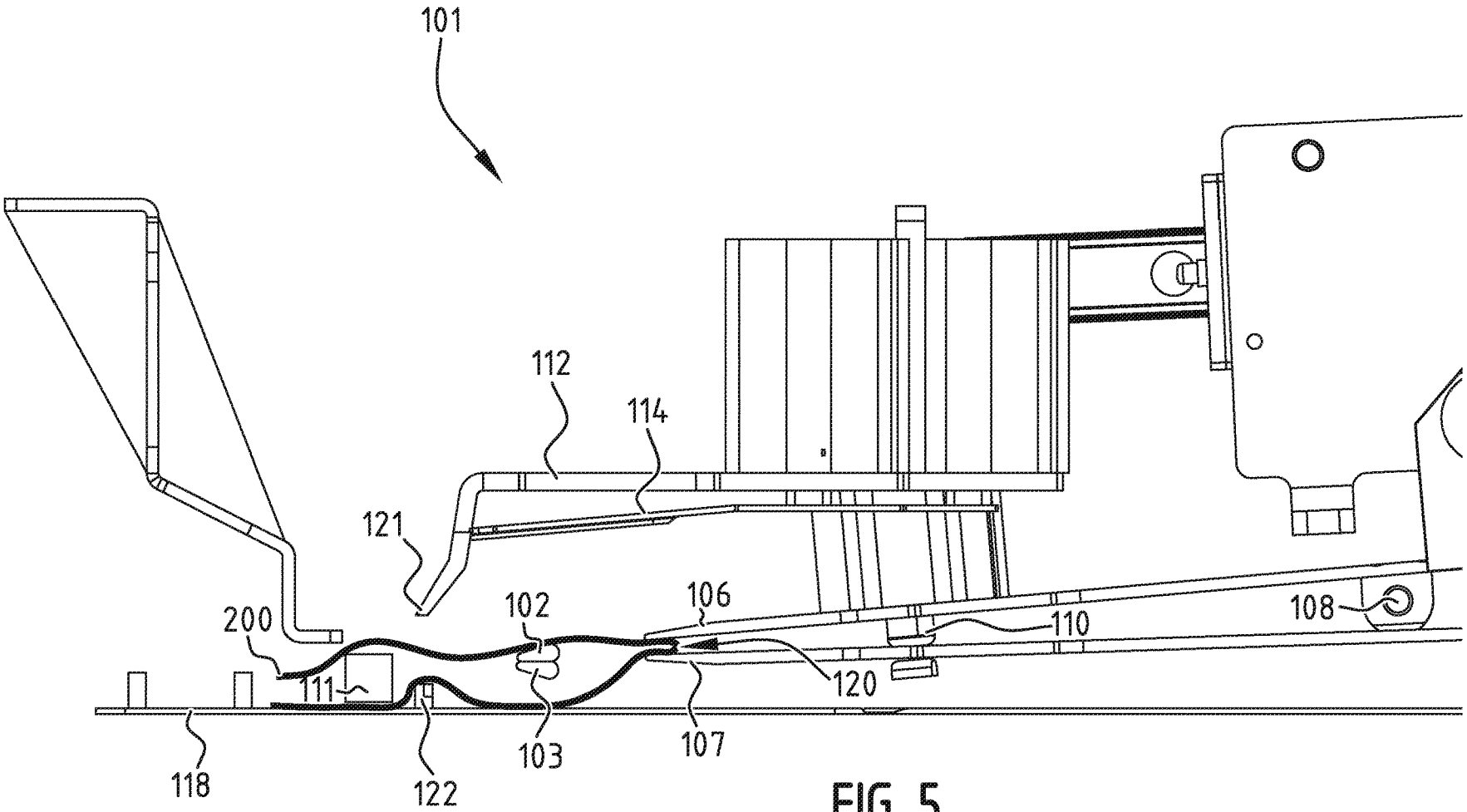

The pleating fingers 102, 103 in the closed state then move away from fold 120, while pleating blades 106, 107 hold the curtain fabric 200 at the position of the fold 120. The presser foot 112 is then moved upward, such that fabric 200 is given space to move. These two steps are shown in FIG. 5.

Figure 6:
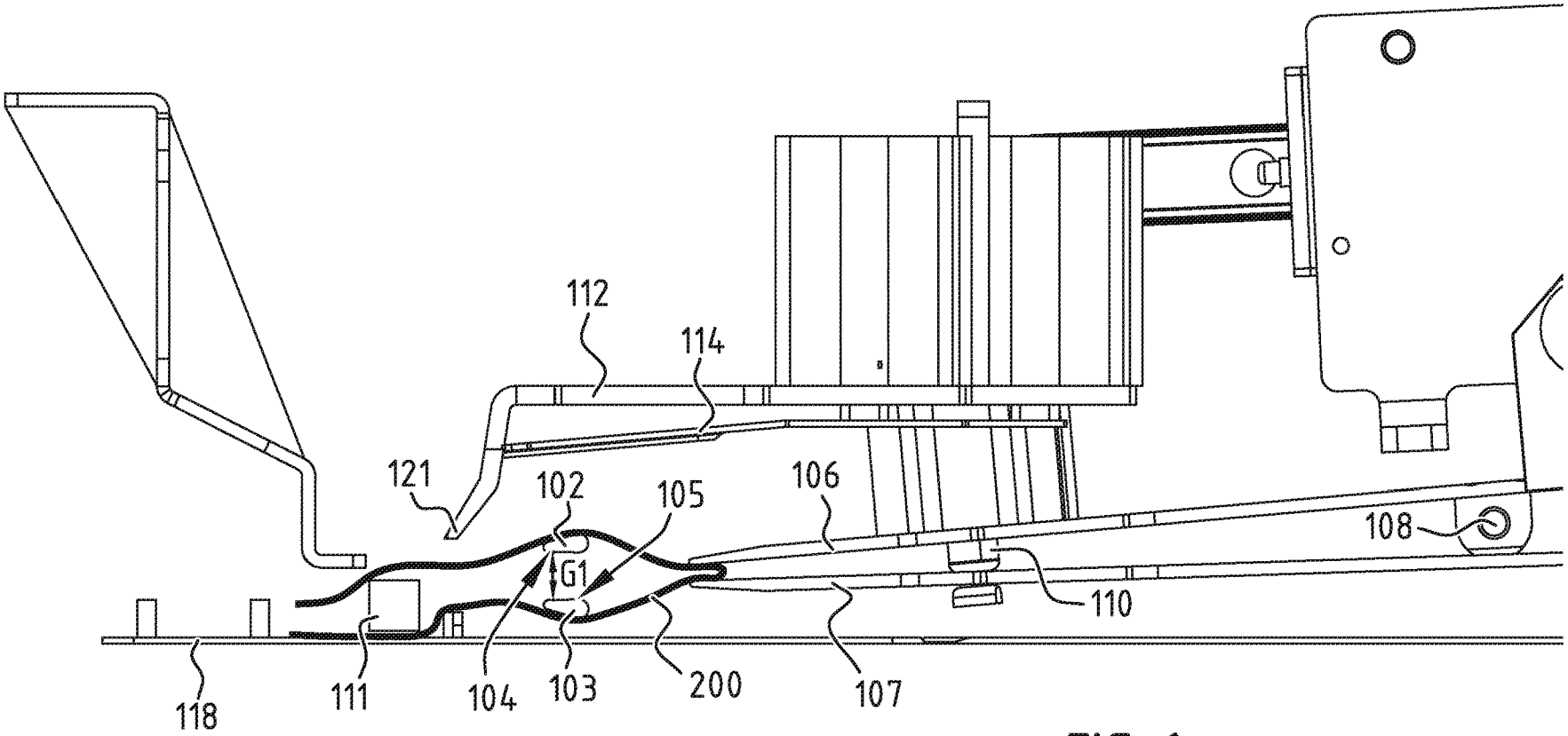

After presser foot 112 has been moved upward the pleating fingers 102, 103 are moved to the open state. Movement to the open state is facilitated in that the presser foot 112 is moved upward, whereby curtain fabric 200 is given space. In the open state the intermediate space G1 has resulted between pleating fingers 102, 103, between which can be arranged end portions 108, 109 of pleating blades 106, 107 with the folded curtain fabric 200 clamped therebetween. In this respect reference is made to the situation as shown in FIG. 6.

Finally, pleating blades 106, 107 with the folded portion of curtain 200 clamped therebetween are arranged between the elongate pleating fingers 102, 103, so that a second loop/pleat 126 and a third loop/pleat 27 is formed on each of either side of the loop/pleat 125 situated between pleating blades 106, 107. The movement of the pleating blades 106, 107 between the elongate pleating fingers 102, 103 is such that the folds 128, 129 of respectively the second and the third pleat 126, 127 are arranged at the position of the fold 120 of the first pleat 125.

Figure 7:
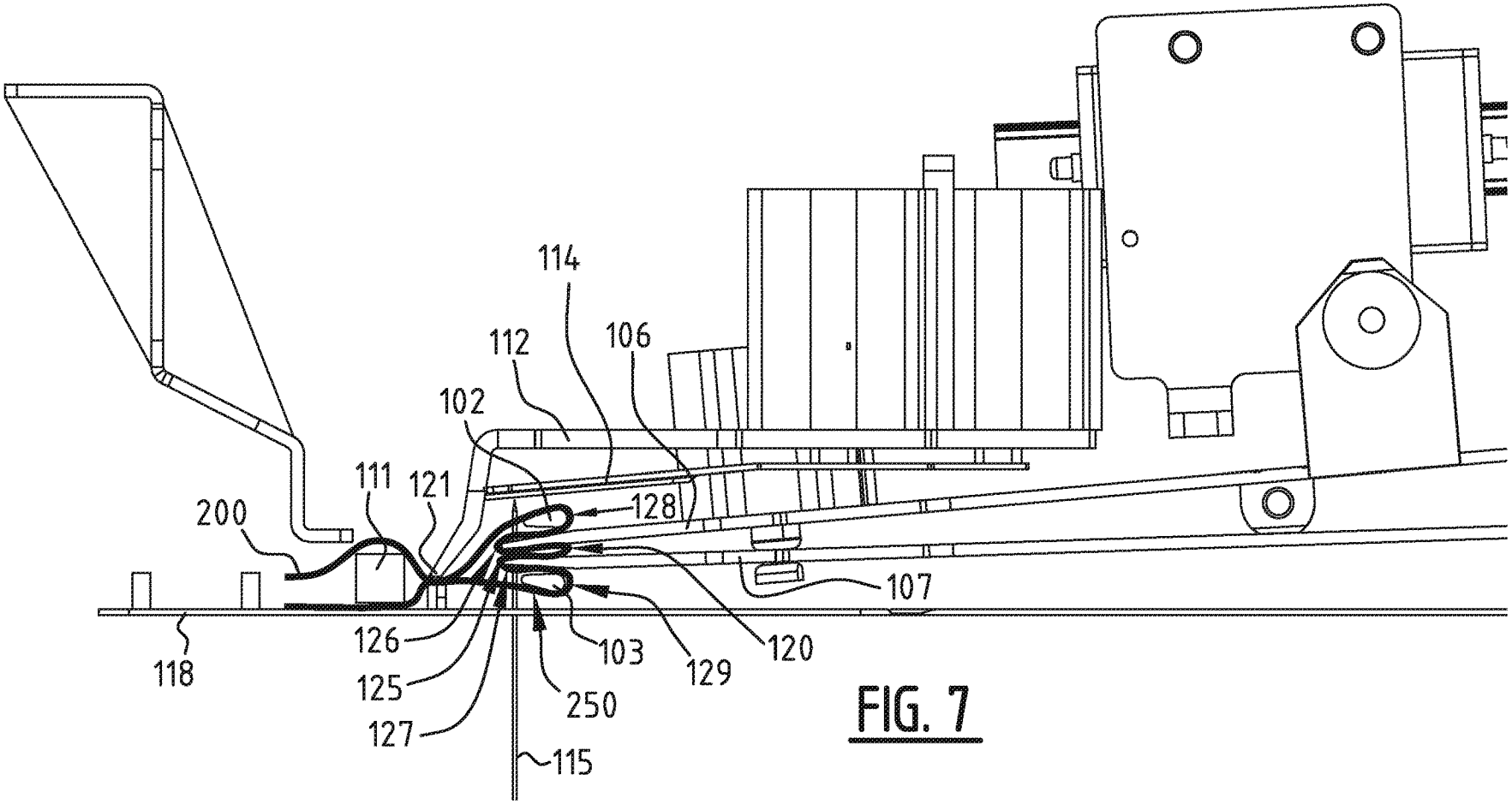

Presser foot 112 then moves downward so that the outer ends 121 thereof are once again arranged on the upright edges 122 of table plate 118. The presser plate 114 situated on the underside of presser foot 112 simultaneously presses the package 250 of the three pleats 125, 126, 127 together before the fixing needles 115 situated under table 113 are arranged through each of the pleats 125, 126, 127 of triple pleat 250. The needles 115 here move successively through the recesses in table plate 118 and pleating blades 106, 107. Reference is made to FIG. 7.

Presser foot 112 with presser plate 114 is then moved upward so that pleating blades 106, 107 can be moved out from between pleats 125 and 126 and pleats 125 and 127 with little friction. Pleating blades 106, 107 here move rearward, i.e. to the right in the views of FIGS. 3-7. When pleating blades 106, 107 have been removed from triple pleat 250, presser foot 112 with presser plate 114 is moved back downward in order to press together the package of three mutually adjacent pleats 125, 126, 127.

Pleating fingers 102, 103 are then removed from the outer pleats 126, 127 of triple pleat 250. Pleating fingers 102, 103 here move out of pleats 126 and 127 in their longitudinal direction, i.e. in a direction out of the paper in the views of FIGS. 3-7. Simultaneously to removal of the pleating fingers 102, 103, the knock-out pin 111 is also removed in the same direction as pleating fingers 102, 103 from the folded-over portion of the curtain fabric 200 which is situated on a side of outer ends 121 of presser foot 112 remote from triple pleat 250. The hook also to be stitched in remains here in said folded-over the portion of the curtain fabric.

Finally, the triple pleat 250 is formed permanently by fixing the triple pleat 250 by means of stitching using a sewing machine (not shown).

The pleating blades 106, 107, pleating fingers 102, 103, knock-out pin 111, presser foot 112 with presser plate 114, fixing needles 115 and the sewing machine, among other things, are controlled by control means (not shown) of the machine 100. Parameters of the pleats to be arranged can be set using a touchscreen 130.

The present invention is not limited to the shown embodiments but also extends to other embodiments falling within the scope of protection of the appended claims.

The invention claimed is:

1. A device for manufacturing a pleated curtain, comprising:

elongate pleating means configured to form a first fold with a predetermined pleat height in the curtain by folding the curtain round a long side of the pleating means along a fold line;

clamping means configured to clamp a pleat portion of the curtain on either side of the first fold over the predetermined pleat height at least along a clamping line parallel to the fold line and at a predetermined pleat depth distance from the fold line, such that the pleat portion, as seen in a cross-sectional plane perpendicular to the fold line, forms a U-shaped loop; and control means for controlling the pleating means and the clamping means;

wherein the control means are configured to move the pleating means and/or the clamping means relative to each other such that, as seen in said cross-sectional plane, the pleating means are arranged from a position inside the loop to a position adjacently of the loop, while the clamping means clamp the pleat portion, such that a remaining portion of the curtain differing from the pleat portion is folded round an outer end of the clamping means and at least a second fold round the pleating means arranged adjacently of the loop is formed adjacently of and parallel to the first fold.

2. The device according to claim 1, wherein the control means are further configured to successively:

arrange the clamping means round the pleat portion such that the clamping means at least make contact with the pleat portion, wherein the pleating means are arranged in the loop;

move the pleating means away from the fold line in a pleat depth direction perpendicularly of the fold line over a distance greater than the predetermined pleat depth distance, such that the pleating means move out of the loop;

clamp the loop at the predetermined pleat depth distance with the clamping means; and move the pleating means along an outer side of the clamping means and arrange them adjacently of the loop.

3. The device according to claim 1, wherein the pleating means comprise two elongate pleating fingers which extend parallel to each other in their longitudinal direction and are movable between a closed state, in which the pleating fingers lie against each other along their length, and an open state in which the pleating fingers are removed a distance from each other such that they can each be arranged on one of either side of the loop by the movement of the pleating means and/or the clamping means perpendicularly of the extending direction of the fold line, while the clamping means clamp the loop.

4. The device according to claim 3, wherein the control means are configured to hold the pleating fingers in the closed state until the pleating fingers are situated outside the loop and to bring them into the open state before the pleating fingers are arranged adjacently of the loop along the outer side of the clamping means.

5. The device according to claim 3, wherein in the open state an intermediate space is formed between the pleating fingers, this having a height such that the clamping means with the loop therebetween can be arranged in the intermediate space and wherein the control means are further configured to enable the pleating fingers to be arranged on either side of the loop by moving the clamping means with the loop therebetween into the intermediate space.

6. The device according to claim 1, wherein the control means are configured to arrange the pleating means at the position of the fold line of the first fold on the outer side of the loop.

7. The device according to claim 1, further comprising a table for arranging thereon the curtain pleated round the pleating means and a presser foot arranged opposite the table and configured to press the pleated curtain against the table on a side of the clamping line remote from the fold line.

8. The device according to claim 7, wherein the control means are configured to move the presser foot toward the table in order to press the curtain against the table with the presser foot until the pleating means are outside the loop and the clamping means clamp the loop.

9. The device according to claim 7, wherein the control means are configured to move the presser foot away from the table after the pleating means have been arranged outside the loop and the clamping means clamp the loop, and before the pleating means are arranged adjacently of the loop.

10. The device according to claim 7, further comprising a presser plate configured to press the loop and pleated portions of the curtain lying adjacently of the loop against the table, wherein the control means are configured to move the presser plate toward the table in order to press the curtain against the table with the presser plate after the pleating means have been arranged adjacently of the loop.

11. The device according to claim 10, wherein the presser plate is provided on the presser foot, such that a movement of the presser foot from and to the table results in a movement of the presser plate respectively from and to the table.

12. The device according to claim 1, further comprising fixing needles configured to fix the loop and the pleated portions of the curtain lying adjacently of the loop relative to each other by arranging the fixing needles through the loop and the pleated portions of the curtain lying adjacently of the loop.

13. The device according to claim 10, wherein the clamping means comprise recesses for arranging the fixing needles therethrough.

14. The device according to claim 10, wherein the control means are further configured to arrange the fixing needles through the loop and the pleated portions of the curtain lying adjacently of the loop after the presser plate presses the curtain against the table after the pleating means have been arranged adjacently of the loop.

15. The device according to claim 14, wherein the control means are further configured to move the clamping means and the pleating means away from the loop and the pleated portions of the curtain lying adjacently of the loop after the fixing needles have been arranged through the loop and the pleated portions of the curtain lying adjacently of the loop, such that the loop and the pleated portions lying adjacently of the loop lie clear of the clamping means and the pleating means.

16. The device according to claim 15, wherein the control means are further configured to move the presser plate away from the table before the clamping means and the pleating means are moved away from the loop and the pleated portions of the curtain lying adjacently of the loop, and to move the presser plate toward the table after the loop and the pleated portions lying adjacently of the loop have come to lie clear of the clamping means and the pleating means.

17. The device according to claim 1, further comprising a sewing device for fixing the loop and portions of the curtain pleated adjacently of the loop by means of stitching, such that the portions pleated adjacently of the loop form loops adjacently of the loop.

* * * * *